US006526236B1

(12) United States Patent
Slattery et al.

(10) Patent No.: US 6,526,236 B1
(45) Date of Patent: Feb. 25, 2003

(54) REPLENISHER MECHANISM FOR A REPRODUCTION APPARATUS DEVELOPMENT STATION WITH CONTINUOUS MONITORING OF REMAINING MARKING PARTICLE MATERIAL

(75) Inventors: Scott Thomas Slattery, Brockport, NY (US); Jerry Eugene Livadas, Webster, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 10/007,998

(22) Filed: Nov. 13, 2001

(51) Int. Cl.[7] ..... G03G 15/08; G03G 15/00
(52) U.S. Cl. ..... 399/27; 399/58
(58) Field of Search ..... 399/27, 252, 258, 399/260, 262; 340/679; 73/290 R, 289 V, 304 C

(56) References Cited

U.S. PATENT DOCUMENTS 5,257,076 A * 10/1993 Nishimura et al. ..... 399/27
5,329,340 A * 7/1994 Kukuchi et al. ..... 399/260
5,652,947 A * 7/1997 Izumizaki ..... 399/258
5,797,074 A * 8/1998 Kasahara et al. ..... 399/258
6,021,294 A * 2/2000 Schmidl et al. ..... 399/258
6,097,903 A * 8/2000 Yahata et al. ..... 399/27
6,229,975 B1 * 5/2001 Wilhelm et al. ..... 399/258
6,298,207 B1 * 10/2001 Slattery et al. ..... 399/258
6,374,064 B1 * 4/2002 Budnik et al. ..... 399/27

FOREIGN PATENT DOCUMENTS

JP 09211952 A * 8/1997

* cited by examiner

*Primary Examiner*—Joan Pendegrass

(57) ABSTRACT

A mechanism for replenishing particulate material from receptacles to a reservoir, which provides a highly accurate and continuous indication of the amount of particulate material remaining in the housing of the replenisher mechanism. The replenisher mechanism includes a housing having a plurality of discrete sensors for sensing the level of particulate material within the housing, a delivery assembly which provides flow communication of particulate material between the housing and a remote reservoir, and has a delivery assembly sensor that senses the amount of particulate material delivered by the delivery assembly. A logic and control unit operatively connected to the housing level sensors and the delivery assembly sensor continuously determines the amount of particulate material remaining in the housing so as to indicate when, and how much, particulate material to add to the housing.

16 Claims, 8 Drawing Sheets

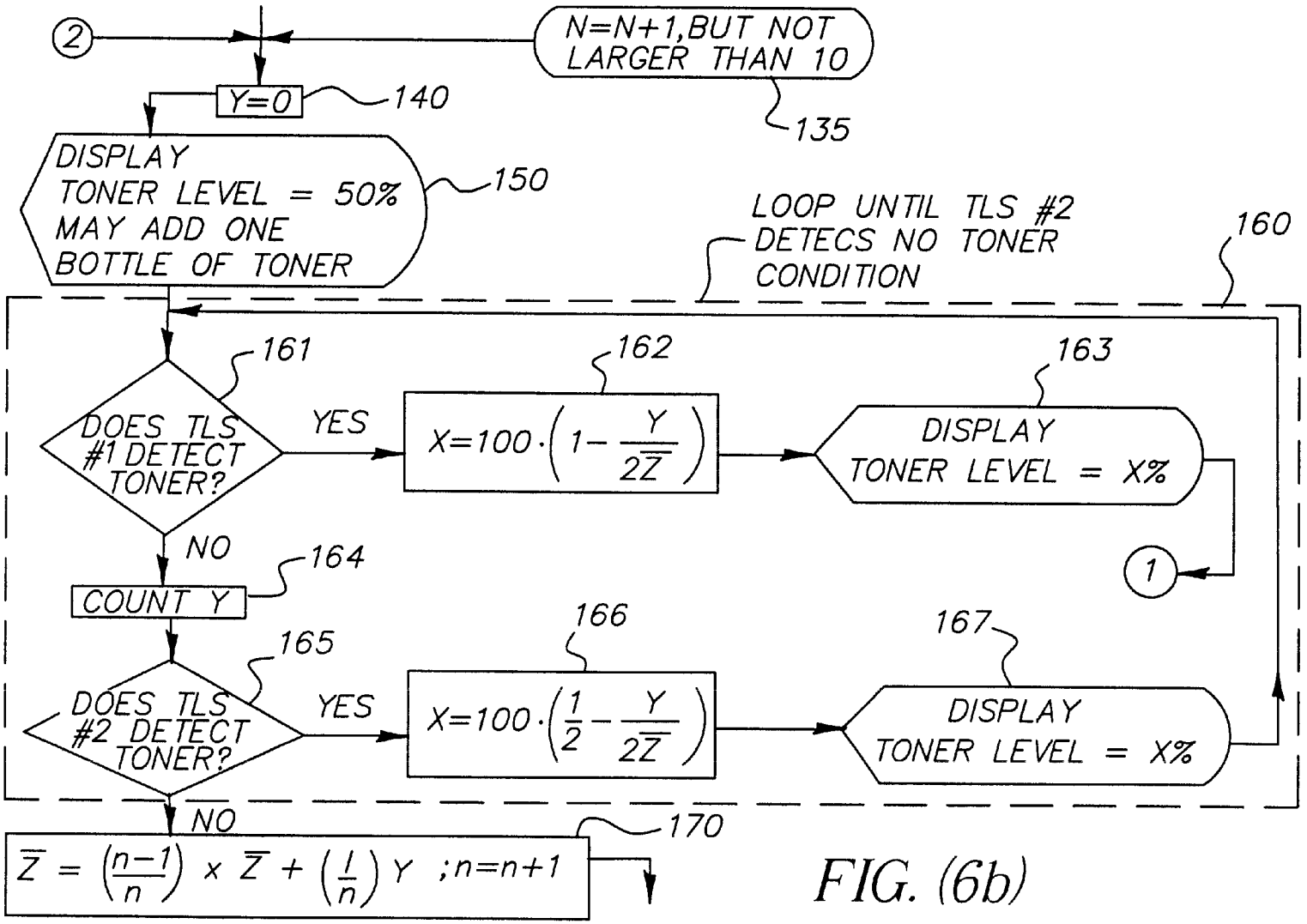
FIG. (6b)

REPLENISHER MECHANISM FOR A REPRODUCTION APPARATUS DEVELOPMENT STATION WITH CONTINUOUS MONITORING OF REMAINING MARKING PARTICLE MATERIAL

FIELD OF THE INVENTION

This invention relates in general to a replenisher mechanism for a developer station of a reproduction apparatus, and more particularly to an electrographic reproduction apparatus development station where the replenisher mechanism for resupplying of marking particle material to a reproduction apparatus development station provides highly accurate and continuous monitoring of the amount of marking particle material remaining in the housing of the replenisher mechanism so as to determine when and how much marking particle material to add to the replenisher mechanism.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

The pigmented marking particle material in such apparatus is typically contained in a replenisher housing and metered out to a development mechanism by a delivery mechanism as needed. Marking particle material, added to the replinisher housing from a receptacle such as a bottle or box, is typically a dry powder with particle size less than 20 microns. It is generally quite cohesive and as a result does not flow very well. Due to these characteristics of the marking particle material, it is very difficult to provide a device that can accurately and continuously monitor the amount of marking particle material remaining in the replenisher housing. Devices that can sense the presence or absence of marking particle material exist and are typically used to indicate when the level in the replenisher housing drops to specific discrete levels such as when it is nearly empty. In this case the amount of marking particle material remaining in the replenisher housing is known only at the discrete instant in time when the sensor changes state and the accuracy is limited by the physical size of the sensor and the uncertainty due to any meniscus effect. One can attempt to continuously monitor the amount of marking particle material remaining in the replenisher housing by monitoring the elapsed time of running of the delivery mechanism combined with a predetermined amount of marking particle material delivered by the delivery mechanism per unit of time. However due to the above mentioned poor flow property of typical marking particle material, the delivery rate has a level of uncertainty also.

Some manufacturers of these types of reproduction apparatus have attempted to determine, on a continuous basis, the amount of marking particle material in the replenisher housing based on some knowledge of the amount of material consumed per output print. In an optical light lens reproduction apparatus, an average material takeout per print might be assumed. Obviously any deviation from average will result in inaccuracy in the computed amount of material remaining in the replenisher housing. In a digital reproduction apparatus a material takeout per print might be calculated based on the number and level of pixels being printed. Any error in the assumed marking particle material delivery to the pixels impacts the accuracy of this material computation method.

In a production printing application, it is highly desirable to be able to run a reproduction apparatus continuously for long job runs without having to stop to add marking particle material to the replenishment housing. This requires that the reproduction apparatus operator receive an accurate indication of the amount of marking particle material remaining in the replenisher housing at any time, especially before starting a long job.

SUMMARY OF THE INVENTION

In view of the above, it is the object of the present invention to provide a replenisher mechanism for a reproduction apparatus, which provides highly accurate and continuous monitoring of the amount of marking particle material remaining in the housing of the replenisher mechanism by a combination of discrete level sensors and continuous sensing of the delivery assembly elapsed activation time. The replenisher mechanism includes a housing having a plurality of discrete sensors for sensing the level of marking particle material within the housing. A delivery assembly provides flow communication of marking particle material between the housing and a remote developer station. A delivery assembly sensor senses the amount of marking particle material delivered by the delivery assembly. A logic and control unit is operatively connected to the housing level sensor and the delivery assembly sensor and, by using signals from both of these sensors, continuously and accurately determines the amount of marking particle material remaining in the housing so as to indicate when, and how much, marking particle material to add to the housing.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
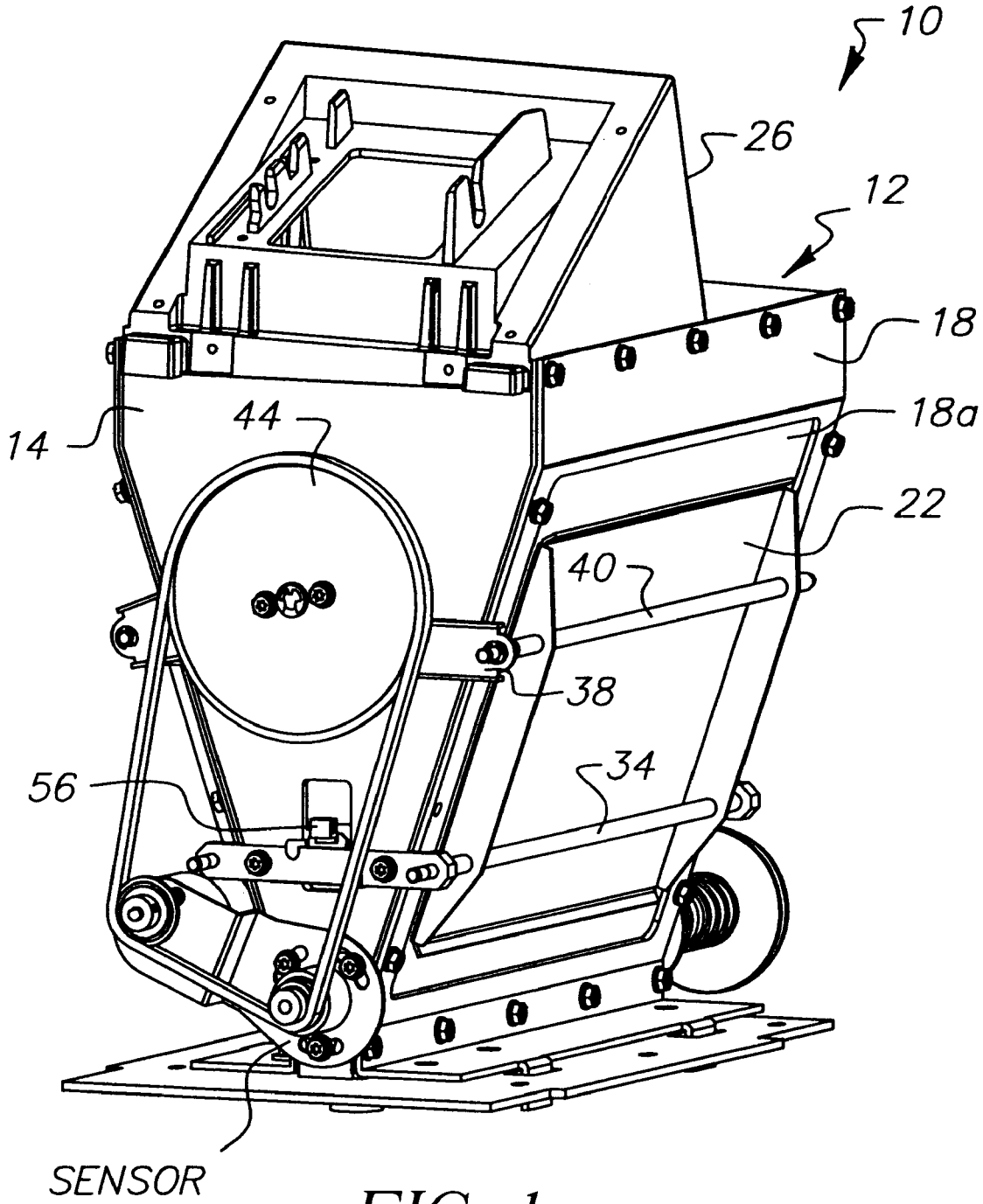
FIG. 1 is a view, in perspective, of the particulate material replenisher mechanism for a development station of a reproduction apparatus, the replenisher mechanism including continuous monitoring of remaining particulate material, according to this invention.
Figure 2:
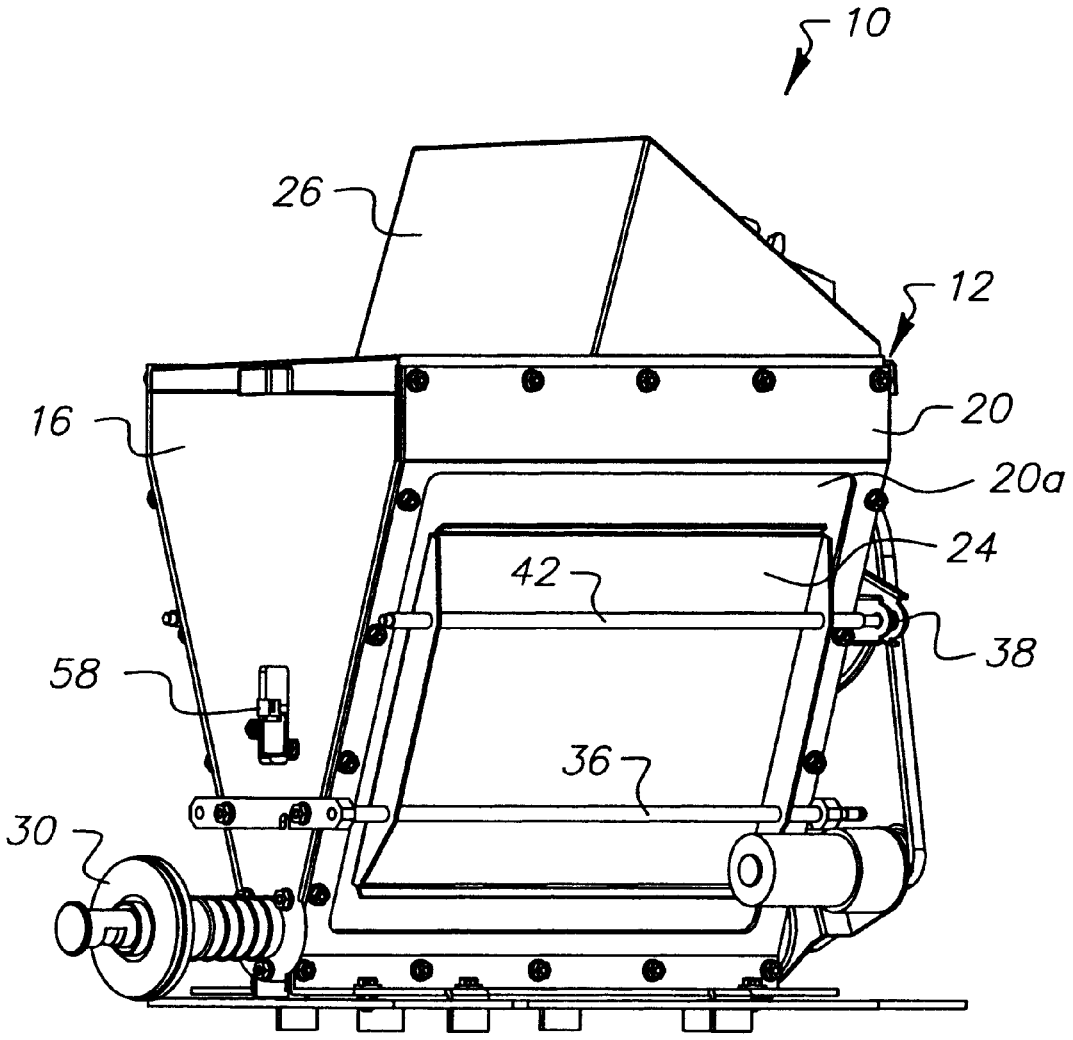
FIG. 2 is a view, in perspective, of the particulate material replenisher mechanism for a development station of a reproduction apparatus of FIG. 1, viewed from the opposite side.
Figure 3:
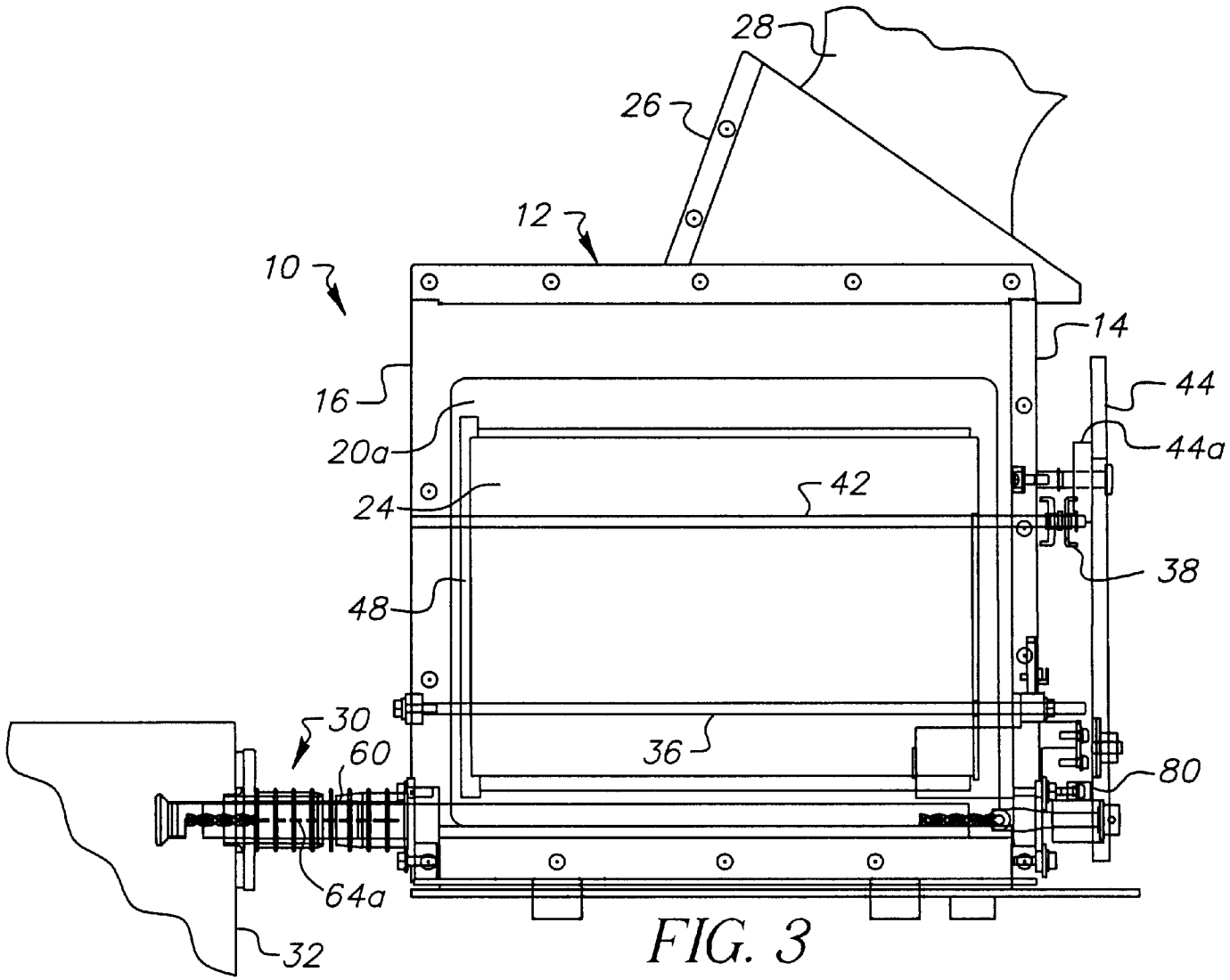
FIG. 3 is a side elevational view of the particulate material replenisher mechanism for a development station of a reproduction apparatus of FIG. 1.

Referring now to the accompanying drawings, a particulate material replenisher mechanism, according to this invention, is best shown in FIGS. 1–3, and designated generally by the numeral 10. The preferred embodiment for the replenisher mechanism is based for example on the replenisher mechanism shown in copending U.S. patent application Ser. No. 09/574,036 filed on May 18, 2000, in the names of Slattery, et al. The following description of such replenisher mechanism is only as detailed as necessary to enable a full understanding of the instant invention.

The replenisher mechanism 10 includes a particulate material housing 12. The housing 12 has a pair of end walls 14, 16 spaced substantially parallel to one another. Connected to, and extending between, the end walls 14, 16 are side walls 18, 20. The side walls 18, 20 are spaced from one another so as to be further apart at the top of the side walls and closer together at the bottom of the side walls.

The replenisher mechanism 10 has an interface 26 mounted on the top of the housing 12 thereof. The interface 26 provides for connection to a particulate material receptacle 28 (see FIG. 3) to enable selective flow communication for the particulate material between the receptacle and the housing 12 of the replenisher mechanism 10. The interface 26 has an angled entrance associated with the particulate material receptacle 28 to allow the particulate material to flow out of the receptacle reliably. Without this angled mounting, particulate material would most likely flow out of the receptacle very slowly and may form a bridge, thereby stopping particle flow all together. Further, the housing 12 includes a particulate material delivery assembly 30 to provide selective flow communication for the particulate material between the housing 12 and a remote reservoir 32 (see FIG. 3), such as a development station of a typical electrographic reproduction apparatus (not shown). The delivery assembly 30 will be described more fully hereinbelow.

Figure 5:
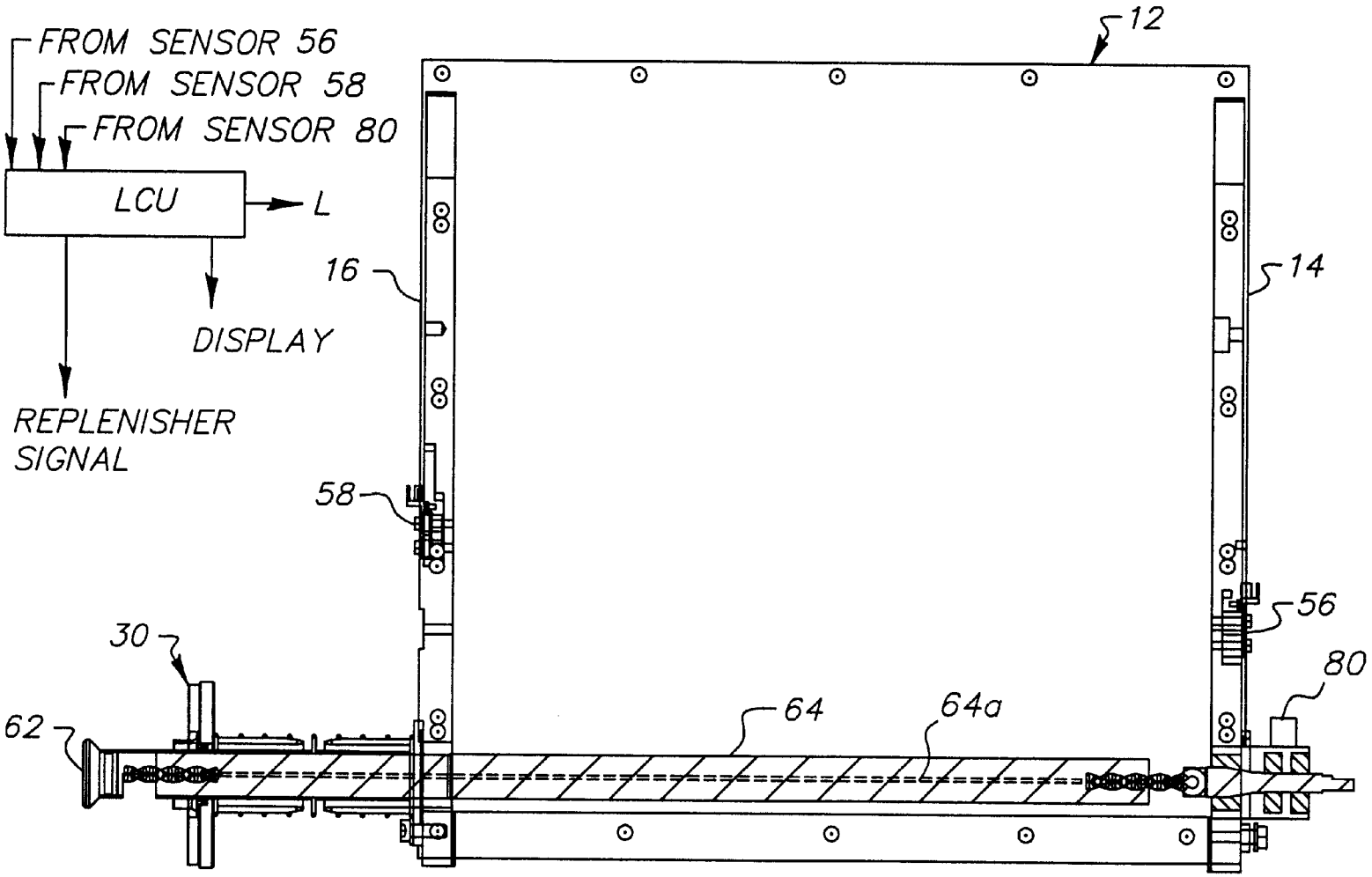
FIG. 5 is a side elevational view, in cross-section, of the particulate material replenisher mechanism housing, showing the location of the level sensors, the delivery assembly feed screw, the delivery assembly sensor, and depicting the logic and control unit.

Further, according to this invention, sensing of the level of particulate material in the housing 12 of the replenisher mechanism 10 is accomplished by providing a sensor assembly having plurality of level sensors 56, 58 (see FIGS. 1, 2, and 5). The level sensors 56, 58 are used with this invention to indicate generally when to add particulate material to the housing 12. Since the housing may hold over two receptacles of particulate material, if material is added too soon an overflow may result. The level sensors 56, 58 are, for example, of the piezoelectric type with the sensing surface being a flat diaphragm. The level sensors 56, 58 are respectively located on the end wall 14, 16 of the housing 12. Each sensor is at a different elevation. The sensors must also be mounted flush or slightly protruding from the end walls so as not to allow a gap in which particulate material can become trapped, thus potentially giving false indication of particulate material level.

The multiple level sensors are used to give a more accurate picture of how much particulate material is left in the housing of the replenisher mechanism 10. As such, when the first (higher) of the sensors (for example, sensor 58 on the end wall 16) changes state to indicate that there is no particulate material in front of it, a signal may be generated indicating that one receptacle of particulate material may be supplied to the housing 12. Further, when the second (lower) of the sensors (for example, sensor 56 on the end wall 14) changes state to indicate that there is no particulate material in front of it, a signal may be generated indicating that more than one receptacle of particulate material may be supplied to the housing 12.

Figure 4:
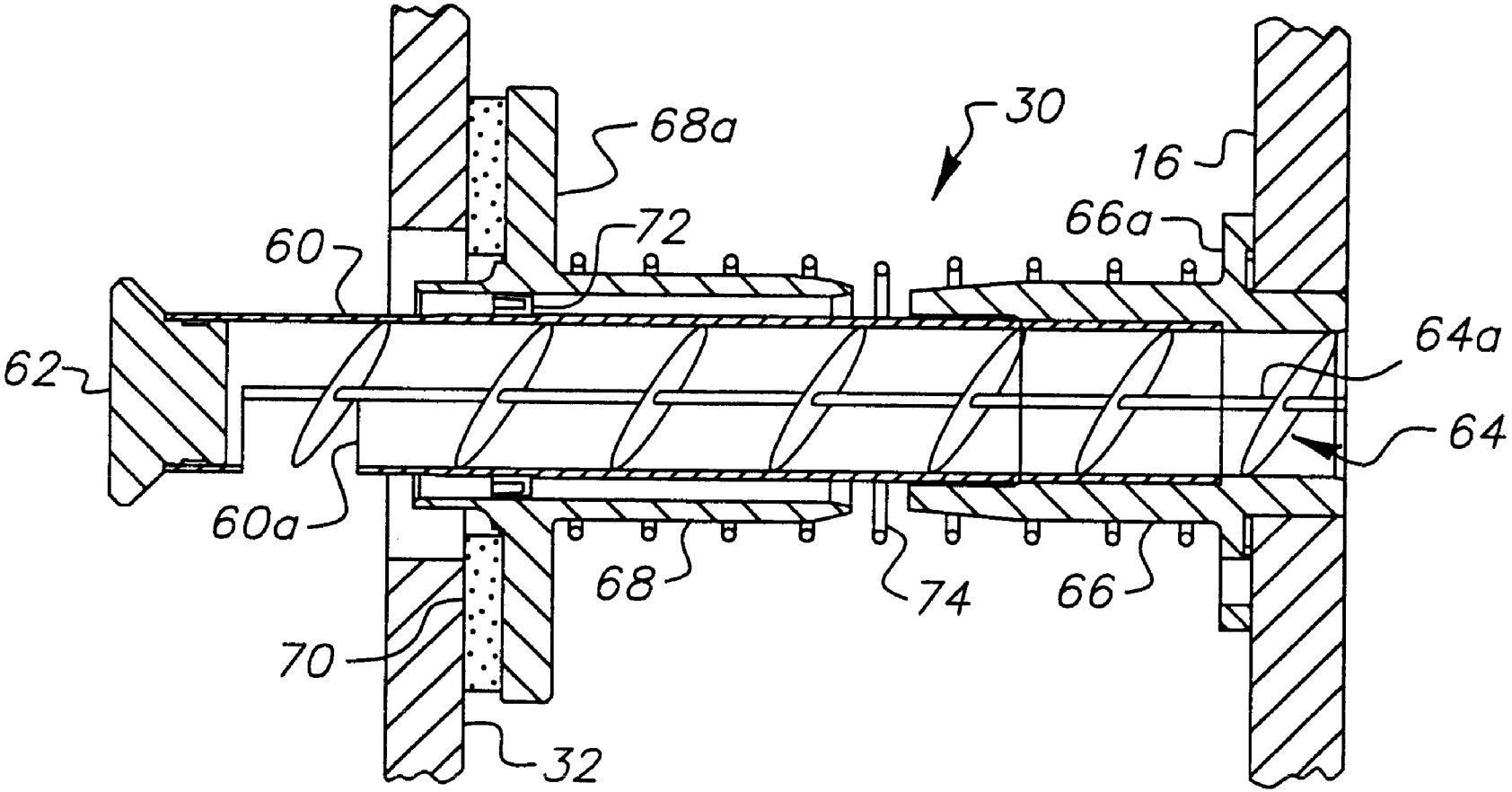
FIG. 4 is a side elevational view, in cross-section and on an enlarged scale, of the output end of the particulate material delivery assembly, shown in its open position.

The particulate material delivery assembly 30 of the replenisher mechanism 10 is best shown in FIGS. 4–5. The delivery assembly 30 includes a delivery tube 60 sealed at one end by a cap 62, and has an opening 60*a* adjacent to the end cap 62. The delivery tube 60 is adapted to accommodate a feed screw 64, which in operation advances particulate material from the housing 12 into the reservoir 32 through the tube. Sensor 80 associated with the shaft 64*a* of the feed screw, senses, for example, the number of revolutions of the feed screw. The amount of particulate material delivered by the delivery assembly 30 for each revolution of the feed screw 64 can thus be predetermined by rotating the feed screw for a fixed number of revolutions, collecting the delivered marking particle material in a suitable container rather than the development mechanism, and then measuring the amount collected in the container. Of course other mechanisms well known in the art may be provided for measuring delivered amount of material per unit of time.

Well known microprocessor based logic and control unit L (see FIG. 5) is operatively connected to the housing sensors 56, 58 and delivery sensor 80. The logic and control unit L receives appropriate signals from the sensors 56, 58, and 80 and, based on such signals, accurately and continuously calculates the amount of particulate material remaining in the replenisher housing 12. As a result of such calculation, the logic and control unit may indicate when, and how much, particulate material to add to the housing 12.

Figure 6A:
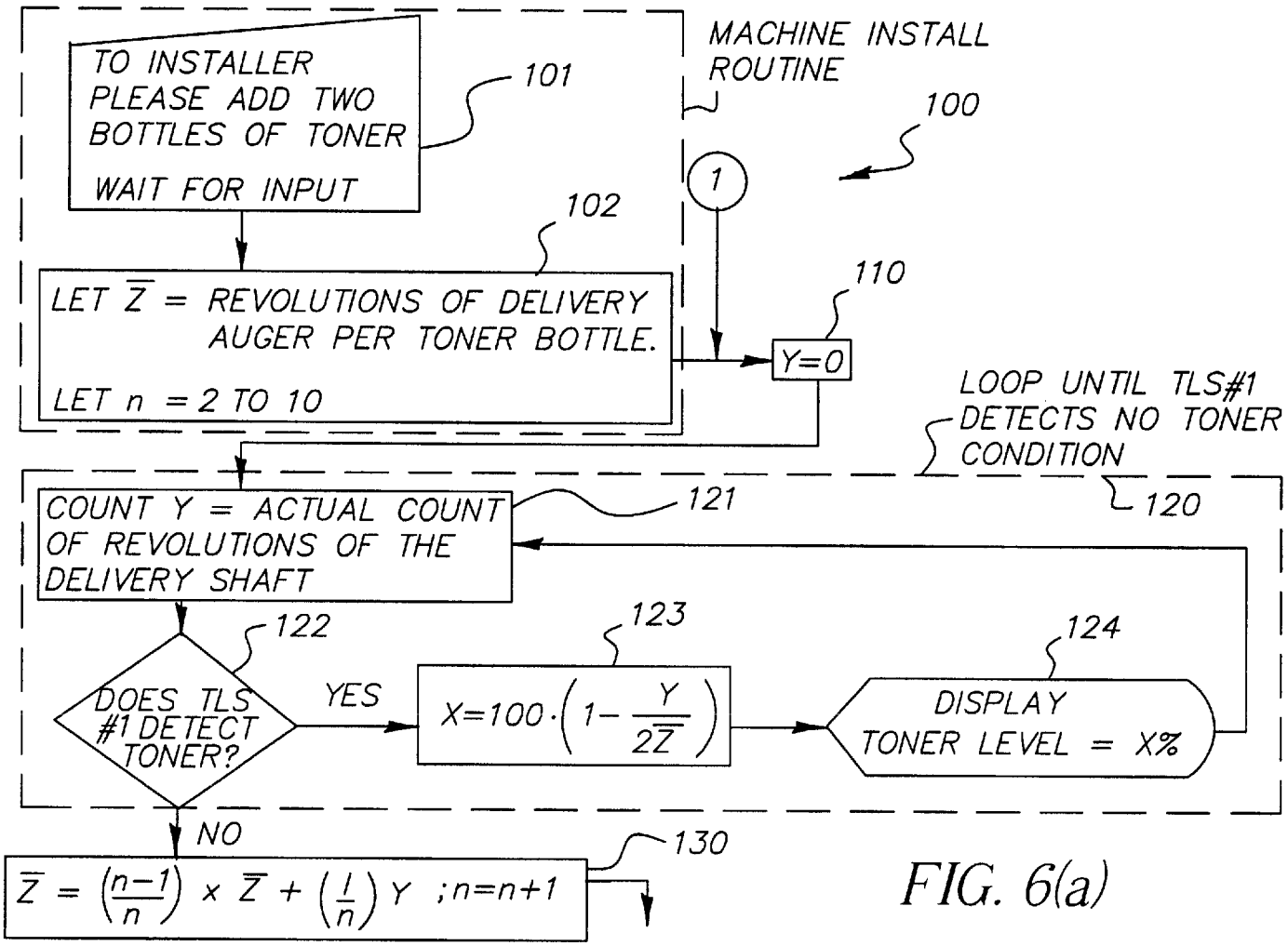
FIGS. 6(*a*), 6(*b*) and 6(*c*) combined depict a logic flow diagram for the addition of particulate material to the replenisher mechanism.
Figure 6C:
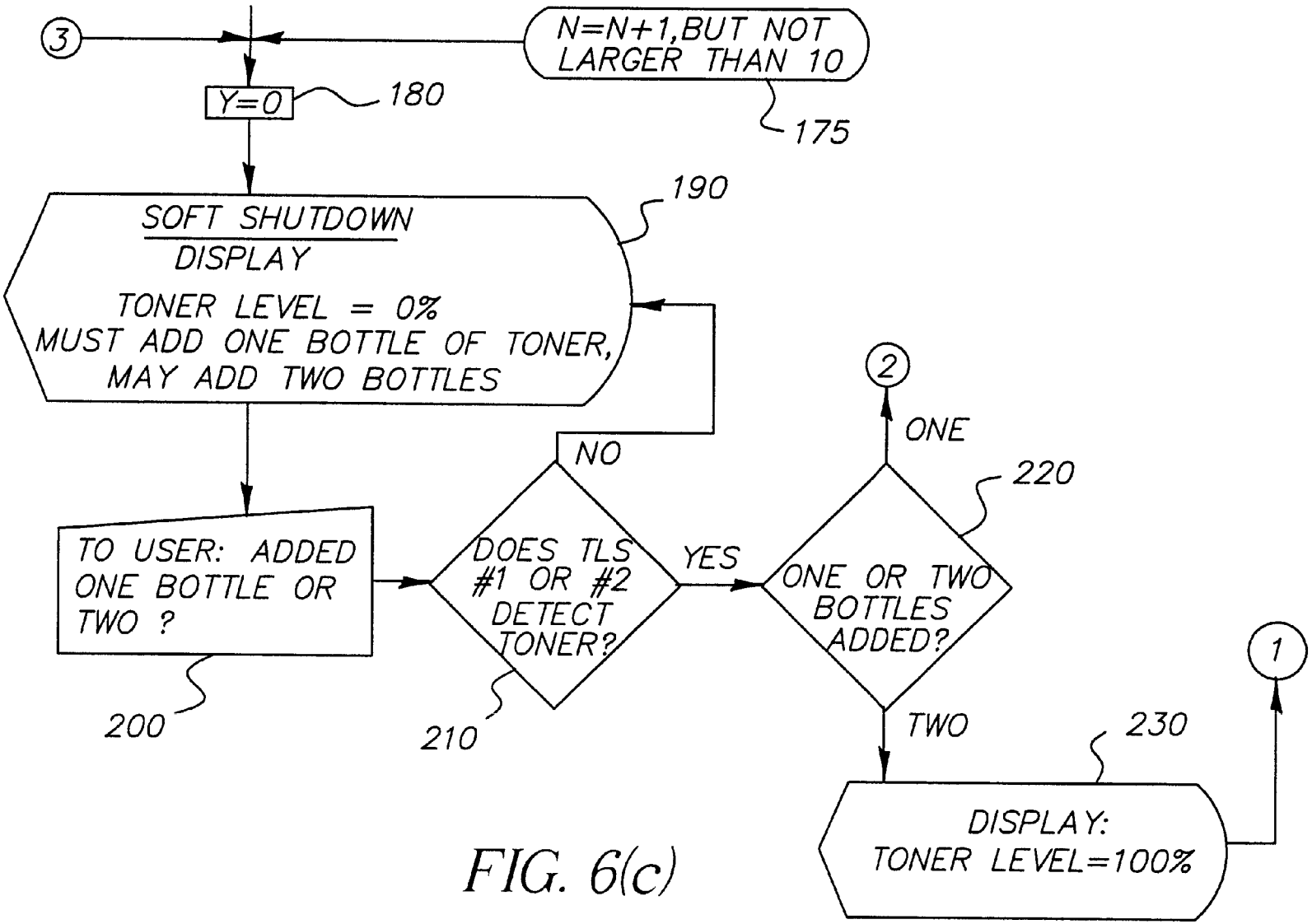

A logic flow diagram 100 for calculating and indicating the amount of particulate material remaining in the housing 12 and when to add more is shown in FIGS. 6(*a*), 6(*b*), and 6(*c*). Initially, on reproduction apparatus install, in step 101 a message 101 is displayed instructing the operator to add two receptacles of particulate material to the replenisher housing (e.g., housing 12). The amount of material in a receptacle is stored in the logic and control unit L. In memory a parameter Z is set equal to the number of feed screw revolutions, predetermined by the procedure described above, required to deliver the amount of particulate material equal to the amount in one receptacle, and a counter n is set equal to 2 (step 102). A parameter Y that represents the number of revolutions of the feed screw 64 is set to zero (step 110). Referring to the steps defined in Box 120, when the particulate material delivery assembly 30 of the replenisher mechanism 10 is activated, the parameter Y is incremented once for each revolution of the feed screw 64 sensed by the sensor 80 (step 121). Each time parameter Y is incremented the logic and control unit L interrogates housing sensor 56 (step 122). If the state of housing sensor 56 indicates the presence of particulate material, the logic and control unit L calculates a parameter X (step 123) according to equation (1) and displays the message "Particulate Material Level =X %" (step 124).

$$X\text{–}100\ [1\text{–}Y/2Z] \qquad (1)$$

The loop depicted in Box 120 is executed each time parameter Y is incremented until the state of housing sensor 56 indicates the absence of particulate material, at which point the logic and control unit L calculates a new value for parameter Z (step 130) according to equation (2), increments counter n (step 135), resets parameter Y to zero (step 140), and displays the message "Particulate Material Level=50%, May add one receptacle of particulate material" (step 150).

$$Z=[(n-1)/n]Z+[1/n]Y \quad (2)$$

Referring to the steps defined in Box 160, the logic and control unit L again interrogates housing sensor 56 (step 161) and, if its state indicates the presence of particulate material, recalculates the parameter X (step 162) according aforementioned to equation (1), displays the message "particulate Material Level=X %" (step 163), and returns to point 1 in the flow diagram. If the state of housing sensor 56 indicates the absence of particulate material, the logic and control unit L begins incrementing the parameter Y (step 164) for each revolution of the feed screw 64 sensed by sensor 80 and interrogates housing sensor 58 each time Y is incremented (step 165). If the state of housing sensor 58 indicates the presence of particulate material, the logic and control unit L recalculates the parameter X step (166) according to equation (1) and displays the message "Particulate Material Level=X % (step 167). The loop depicted in Box 160 is executed each time parameter Y is incremented until the state of housing sensor 58 indicates the absence of particulate material, at which point the logic and control unit L calculates a new value of the parameter Z (step 170) according to equation (2), increments counter n (175), resets parameter Y to zero (step 180), and shuts down the replenisher mechanism 10 and displays the message "particulate Material Level=0%, Must add one receptacle of particulate material, May add two receptacles" (step 190). The logic and control unit L then interrogates both housing sensors 56 and 58 (step 210). Further, in step 200, a message is displayed instructing the user to indicate whether one receptacle or two have been added. If the state of housing sensor 58 indicates the presence of particulate material and the state of housing sensor 56 indicates the absence of particulate material, the logic and control unit L assumes only one receptacle was added and returns to point 2 in the flow diagram (step 220). If the state of both housing sensors 56 and 58 indicate the presence of particulate material, the logic and control unit assumes two receptacles were added (step 220), displays the message "Particulate Material Level=100% (step 230), and returns to point 1 in the flow diagram.

The invention has been described in detail with particular reference to certain preferred embodiments thereof, but it will be understood that variations and modifications can be effected within the spirit and scope of the invention.

What is claimed is:

1. A mechanism for replenishing particulate material from receptacles to a reservoir, each receptacle containing a predetermined quantity of particulate material, said replenisher mechanism comprising:

a housing defining an interior volume large enough to contain more than the quantity of particulate material contained in one of said receptacles, said housing having a first sensor assembly for sensing the amount of particulate material within said housing and producing a signal representative of such amount;

an interface selectively providing flow communication of particulate material from said receptacles to said housing;

a delivery assembly selectively providing flow communication of particulate material from said housing to said reservoir, said delivery assembly having a second sensor assembly for sensing the amount of particulate material delivered by said delivery assembly and producing a signal representative of such amount; and a logic and control unit operatively associated with said first sensor and said second sensor assembly, whereby in response to signals from said first and second sensor assemblies, said logic and control unit continuously determines the amount of particulate material remaining in said housing so as to indicate when, and how much, particulate material to add to said housing from said receptacles.

2. The replenisher mechanism according to claim 1 wherein said first housing sensor assembly includes a plurality of sensors respectively located at different elevations with respect to said housing.

3. The replenisher mechanism according to claim 2 whereby when the sensor of said plurality of sensors located at the highest elevation changes state to indicate that there is no particulate material sensed thereby, a signal is generated indicating that one receptacle of particulate material may be supplied to said housing.

4. The replenisher mechanism according to claim 3 whereby when the sensor of said plurality of sensors located at a lower elevation than said highest elevation sensor changes state to indicate that there is no particulate material thereby, a signal is generated indicating that more than one receptacle of particulate material may be supplied to said housing.

5. The replenisher mechanism according to claim 1 wherein the said delivery assembly includes an activating mechanism and said second sensor assembly senses the elapsed time said delivery assembly is activated to measure the amount of particulate material delivered from said housing to said reservoir.

6. The replenisher mechanism according to claim 5 wherein said delivery assembly includes a delivery tube, said delivery tube being adapted to accommodate a feed screw for advancing particulate material from said housing to said reservoir, said feed screw being rotationally activated, and said sensor or said second sensor assembly senses the revolutions of said feed screw to measure the amount of particulate material delivered from said housing to said reservoir.

7. With a replenisher mechanism for replenishing particulate material from receptacles, each containing a predetermined quantity of particulate material, to a reservoir, said replenisher mechanism including a housing which is large enough to contain more than the quantity of particulate material contained in one of said receptacles, and a delivery assembly providing selective flow communication of particulate material from said housing to said reservoir, a method controlling the amount of particulate material in said housing, comprising the steps of:

a) storing in memory the predetermined quantity of particulate material in one of said receptacles;

b) storing in memory the amount of particulate material in said housing when said housing is full;

c) storing in memory the predetermined rate that said delivery assembly, when activated, delivers particulate material from said housing to said reservoir;

d) delivering particulate material from said housing to said reservoir and, by sensing the elapsed time the delivery assembly is activated, and utilizing the stored predetermined rate of delivery, decrementing said full housing memory amount by the amount representative of particulate material that has flowed from said housing;

e) sensing when the quantity of particulate material in said housing is depleted to a first predetermined amount and, by comparing this amount to the amount determined from the elapsed time the delivery assembly was activated, making a correction to said predetermined delivery rate stored in memory in step (c) and said decremented full housing amount stored in memory from step (d); and f) determining from steps (d) and (e) the precise amount of particulate material remaining in said housing at any time and, in response, adding particulate material from one said receptacle to said housing.

8. In the method of particulate material replenishment according to claim 7, in step (f), adding particulate material from more than one said receptacle to said housing.

9. In a reproduction apparatus, a mechanism for replenishing marking particle material from marking particle receptacles to a developer station, each receptacle containing a predetermined quantity of marking particle material, said replenisher mechanism comprising:

a housing defining an interior volume large enough to contain more than the quantity of marking particle material contained in one of said receptacles, said housing having a first sensor assembly for sensing the amount of marking particle material within said housing and producing a signal representative of such amount;

an interface selectively providing flow communication of marking particle material from said receptacles to said housing;

a delivery assembly selectively providing flow communication of marking particle material from said housing to said development station, said delivery assembly having a second sensor assembly for sensing the amount of marking particle material delivered by said delivery assembly and producing a signal representative of such amount; and a logic and control unit operatively associated with said first sensor assembly and said second sensor assembly, whereby in response to signals from said first and second sensor assemblies, said logic and control unit continuously determines the amount of marking particle material remaining in said housing so as to indicate when, and how much, marking particle material to add to said housing from said receptacles.

10. The replenisher mechanism according to claim 9 wherein said first sensor assembly includes a plurality of sensors respectively located at different elevations with respect to said housing.

11. The replenisher mechanism according to claim 10 whereby when the sensor of said plurality of sensors located at the highest elevation changes state to indicate that there is no marking particle material sensed thereby, a signal is generated indicating that one receptacle of marking particle material may be supplied to said housing.

12. The replenisher mechanism according to claim 11 whereby when the sensor of said plurality of sensors located at a lower elevation than said highest elevation sensor changes state to indicate that there is no marking particle material thereby, a signal is generated indicating that more than one receptacle of marking particle material may be supplied to said housing.

13. The replenisher mechanism according to claim 9 wherein the said delivery assembly includes an activating mechanism and said second sensor assembly senses the elapsed time said delivery assembly is activated to measure the amount of marking particle material delivered from said housing to said developer station.

14. The replenisher mechanism according to claim 13 wherein said delivery assembly includes a delivery tube, said delivery tube being adapted to accommodate a feed screw for advancing marking particle material from said housing to said developer station, said feed screw being rotationally activated, and said sensor of said second sensor assembly senses the revolutions of said feed screw to measure the amount of marking particle material delivered from said housing to said developer station.

15. With a replenisher mechanism for replenishing marking particle material from receptacles, each containing a predetermined quantity of marking particle material, to a developer station, said replenisher mechanism including a housing which is large enough to contain more than the quantity of marking particle material contained in one of said receptacles, and a delivery assembly providing selective flow communication of marking particle material from said housing to said developer station, a method controlling the amount of marking particle material in said housing, comprising the steps of:

a) storing in memory the predetermined quantity of marking particle material in one of said receptacles;

b) storing in memory the amount of marking particle material in said housing when said housing is full;

c) storing in memory the predetermined rate that said delivery assembly, when activated, delivers marking particle material from said housing to said developer station;

d) delivering marking particle material from said housing to said developer station and, by sensing the elapsed time the delivery assembly is activated, and utilizing the stored predetermined rate of delivery, decrementing said full housing memory amount by the amount representative of marking particle material that has flowed from said housing;

e) sensing when the quantity of marking particle material in said housing is depleted to a first predetermined amount and, by comparing this amount to the amount determined from the elapsed time the delivery assembly was activated, making a correction to said predetermined delivery rate stored in memory in step (c) and said decremented full housing amount stored in memory from step (d); and f) determining from steps (d) and (e) the precise amount of marking particle material remaining in said housing at any time and, in response, adding marking particle material from one said receptacle to said housing.

16. In the method of marking particle replenishment according to claim 15, in step (f), adding marking particle material from more than one said receptacle to said housing.

* * * * *